US011743662B2

(12) United States Patent
Oosugi et al.

(10) Patent No.: US 11,743,662 B2
(45) Date of Patent: Aug. 29, 2023

(54) VOICE INPUT/OUTPUT APPARATUS, HEARING AID, VOICE INPUT/OUTPUT METHOD, AND VOICE INPUT/OUTPUT PROGRAM

(71) Applicants: NEC Corporation, Tokyo (JP); NEC Platforms, Ltd., Kawasaki (JP)

(72) Inventors: Kouji Oosugi, Tokyo (JP); Takayuki Arakawa, Tokyo (JP); Akihiko Sugiyama, Tokyo (JP); Ryoji Miyahara, Kanagawa (JP)

(73) Assignees: NEC CORPORATION, Tokyo (JP); NEC Platforms, Ltd., Kanagawa (JP)

( * ) Notice: Subject to any disclaimer, the term of this patent is extended or adjusted under 35 U.S.C. 154(b) by 107 days.

(21) Appl. No.: 17/417,491

(22) PCT Filed: Dec. 16, 2019

(86) PCT No.: PCT/JP2019/049173
§ 371 (c)(1),
(2) Date: Jun. 23, 2021

(87) PCT Pub. No.: WO2020/137654
PCT Pub. Date: Jul. 2, 2020

(65) Prior Publication Data

US 2021/0392445 A1 Dec. 16, 2021

(30) Foreign Application Priority Data

Dec. 28, 2018 (JP) ..... 2018-248765

(51) Int. Cl.
*H04R 25/00* (2006.01)
*G10L 21/0208* (2013.01)

(52) U.S. Cl.
CPC ..... *H04R 25/502* (2013.01); *G10L 21/0208* (2013.01); *H04R 25/603* (2019.05); *G10L 2021/02082* (2013.01)

(58) Field of Classification Search
None
See application file for complete search history.

(56) References Cited

U.S. PATENT DOCUMENTS 9,716,529 B1 * 7/2017 Dai ..... H04L 25/03885
2004/0071284 A1 * 4/2004 Abutalebi ..... H04B 3/234 379/406.14

(Continued)

FOREIGN PATENT DOCUMENTS

CN 108429950 A 8/2018
JP H06-014101 A 1/1994

(Continued)

OTHER PUBLICATIONS

Extended European Search Report for EP Application No. EP19902465.4 dated Jan. 27, 2022.

(Continued)

*Primary Examiner* — Walter F Briney, III

(57) ABSTRACT

By performing both noise cancellation and echo cancellation, a high-quality main voice signal is generated. A voice input/output apparatus includes a noise acquirer that is arranged toward an outside of a body of a user and acquires external noise arriving from the outside of the user, a voice output unit that accepts an input of a voice signal and outputs a voice to an ear canal of the user, a main voice acquirer that acquires a mixed voice, in which the external noise, the output voice, and a main voice of the user transmitted from a vocal cord of the user through the ear canal are mixed, and outputs a mixed voice signal, a noise canceler that processes the mixed voice signal using a noise signal based on the (Continued)

external noise, and an echo canceler that processes the mixed voice signal using the voice signal.

15 Claims, 15 Drawing Sheets

(56) References Cited

U.S. PATENT DOCUMENTS

| | | | | |
|---|---|---|---|---|
| 2009/0034765 | A1* | 2/2009 | Boillot | H04R 25/02 381/59 |
| 2011/0293103 | A1 | 12/2011 | Park et al. | |
| 2015/0296296 | A1 | 10/2015 | Lu et al. | |
| 2017/0188129 | A1* | 6/2017 | Sindia | H03G 3/3005 |
| 2017/0221501 | A1 | 8/2017 | Yen | |
| 2018/0343514 | A1 | 11/2018 | Dusan et al. | |
| 2019/0130930 | A1* | 5/2019 | Tong | G10L 21/0208 |
| 2019/0259381 | A1* | 8/2019 | Ebenezer | H04R 3/005 |
| 2019/0394576 | A1* | 12/2019 | Petersen | H04R 25/407 |
| 2020/0177995 | A1* | 6/2020 | Montreevat | H04W 4/80 |
| 2021/0006900 | A1* | 1/2021 | Ohashi | G10K 11/17854 |

FOREIGN PATENT DOCUMENTS

| | | | |
|---|---|---|---|
| JP | H07-240989 | A | 9/1995 |
| JP | H09-018291 | A | 1/1997 |
| JP | 2002076998 | A | 3/2002 |
| JP | 2006-295533 | A | 10/2006 |
| JP | 2013-532308 | A | 8/2013 |
| JP | 2013-546253 | A | 12/2013 |
| JP | 2015061115 | A | 3/2015 |
| JP | 2017011754 | A | 1/2017 |
| JP | 2017515149 | A | 6/2017 |
| JP | 2017-536062 | A | 11/2017 |
| JP | 2018-512794 | A | 5/2018 |
| JP | 2018-137735 | A | 8/2018 |

OTHER PUBLICATIONS

Japanese Office Action for JP Application No. 2020-200610 dated Nov. 30, 2021 with English Translation.

Japanese Office Communication for JP Application No. 2018-248765 dated Nov. 5, 2020 with English Translation.

International Search Report for PCT Application No. PCT/JP2019/049173, dated Feb. 25, 2020.

English translation of Written opinion for PCT Application No. PCT/JP2019/049173, dated Feb. 25, 2020.

* cited by examiner

VOICE INPUT/OUTPUT APPARATUS, HEARING AID, VOICE INPUT/OUTPUT METHOD, AND VOICE INPUT/OUTPUT PROGRAM

This application is a National Stage Entry of PCT/JP2019/049173 filed on Dec. 16, 2019, which claims priority from Japanese Patent Application 2018-248765 filed on Dec. 28, 2018, the contents of all of which are incorporated herein by reference, in their entirety.

This application claims the benefit of Japanese Patent Application No. 2018-248765 filed on Dec. 28, 2018, which is hereby incorporated by reference herein in its entirety.

TECHNICAL FIELD

The present invention relates to a voice input/output apparatus, a hearing aid, a voice input/output method, and a voice input/output program.

BACKGROUND ART

In the above technical field, patent literature 1 discloses a voice input/output apparatus that outputs a voice from a first loudspeaker and a second loudspeaker when a microphone unit is not used, and outputs a voice from the second loudspeaker while stopping the voice output from the first loudspeaker when the microphone unit is used. Patent literature 2 discloses a technique that improves the S/N of an utterance sound collected signal by suppressing the noise in an internal space by NC processing while ensuring the S/N of the utterance sound collected signal by the sound insulation capability of the housing of an attachment portion against environmental noise.

CITATION LIST

Patent Literature

Patent literature 1: Japanese Patent Laid-Open No. 2015-61115

Patent literature 2: Japanese Patent Laid-Open No. 2017-11754

SUMMARY OF THE INVENTION

Technical Problem

However, in the technique described in the above patent literature 1, it is unnecessary to perform echo cancellation since no echo is generated. In the technique described in the above patent literature 2, it is unnecessary to cancel external noise in a voice signal input to an internal microphone since no environmental noise is input to the internal microphone. That is, it has not been conventionally conceived to cancel external noise in a voice signal captured by the internal microphone and cancel the echo in an output voice from the loudspeaker, so a high-quality main voice signal could not be generated.

The present invention enables to provide a technique of solving the above-described problem.

Solution to Problem

One example aspect of the present invention provides a voice input/output apparatus comprising:

a noise acquirer that is arranged toward an outside of a body of a user and acquires external noise arriving from the outside of the user;

a voice output unit that accepts an input of a voice signal and outputs a voice to an ear canal of the user;

a main voice acquirer that acquires a mixed voice, in which the external noise, the output voice, and a main voice of the user transmitted from a vocal cord of the user through the ear canal are mixed, and outputs a mixed voice signal;

a noise canceler that processes the mixed voice signal using a noise signal based on the external noise; and an echo canceler that processes the mixed voice signal using the voice signal.

Another example aspect of the present invention provides a hearing aid comprising:

a noise acquirer that is arranged toward an outside of a body of a user and acquires external noise arriving from the outside of the user;

a voice output unit that accepts an input of a voice signal and outputs a voice to an ear canal of the user;

a main voice acquirer that acquires a mixed voice, in which the external noise, the output voice, and a main voice of the user transmitted from a vocal cord of the user through the ear canal are mixed, and outputs a mixed voice signal;

a noise canceler that processes the mixed voice signal using a noise signal based on the external noise;

an echo canceler that processes the mixed voice signal using the voice signal; and an amplifier that amplifies a voice signal to be input to the voice output unit.

Still other example aspect of the present invention provides a voice input/output method comprising:

acquiring external noise arriving from an outside of a user by a noise acquirer arranged toward the outside of a body of the user;

accepting an input of a voice signal and outputting a voice to an ear canal of the user;

acquiring a mixed voice, in which the external noise, the output voice, and a main voice of the user transmitted from a vocal cord of the user through the ear canal are mixed, and outputting a mixed voice signal;

performing noise cancellation by processing the mixed voice signal using a noise signal based on the external noise; and performing echo cancellation by processing the mixed voice signal using the voice signal.

Still other example aspect of the present invention provides a voice input/output program for causing a computer to execute a method, comprising:

acquiring external noise arriving from an outside of a user by a noise acquirer arranged toward the outside of a body of the user;

accepting an input of a voice signal and outputting a voice to an ear canal of the user;

acquiring a mixed voice, in which the external noise, the output voice, and a main voice of the user transmitted from a vocal cord of the user through the ear canal are mixed, and outputting a mixed voice signal;

performing noise cancellation by processing the mixed voice signal using a noise signal based on the external noise; and performing echo cancellation by processing the mixed voice signal using the voice signal.

Advantageous Effects of Invention

According to the present invention, it is possible to generate a high-quality main voice signal by performing both noise cancellation and echo cancellation.

DESCRIPTION OF EXAMPLE EMBODIMENTS

Figure 1:
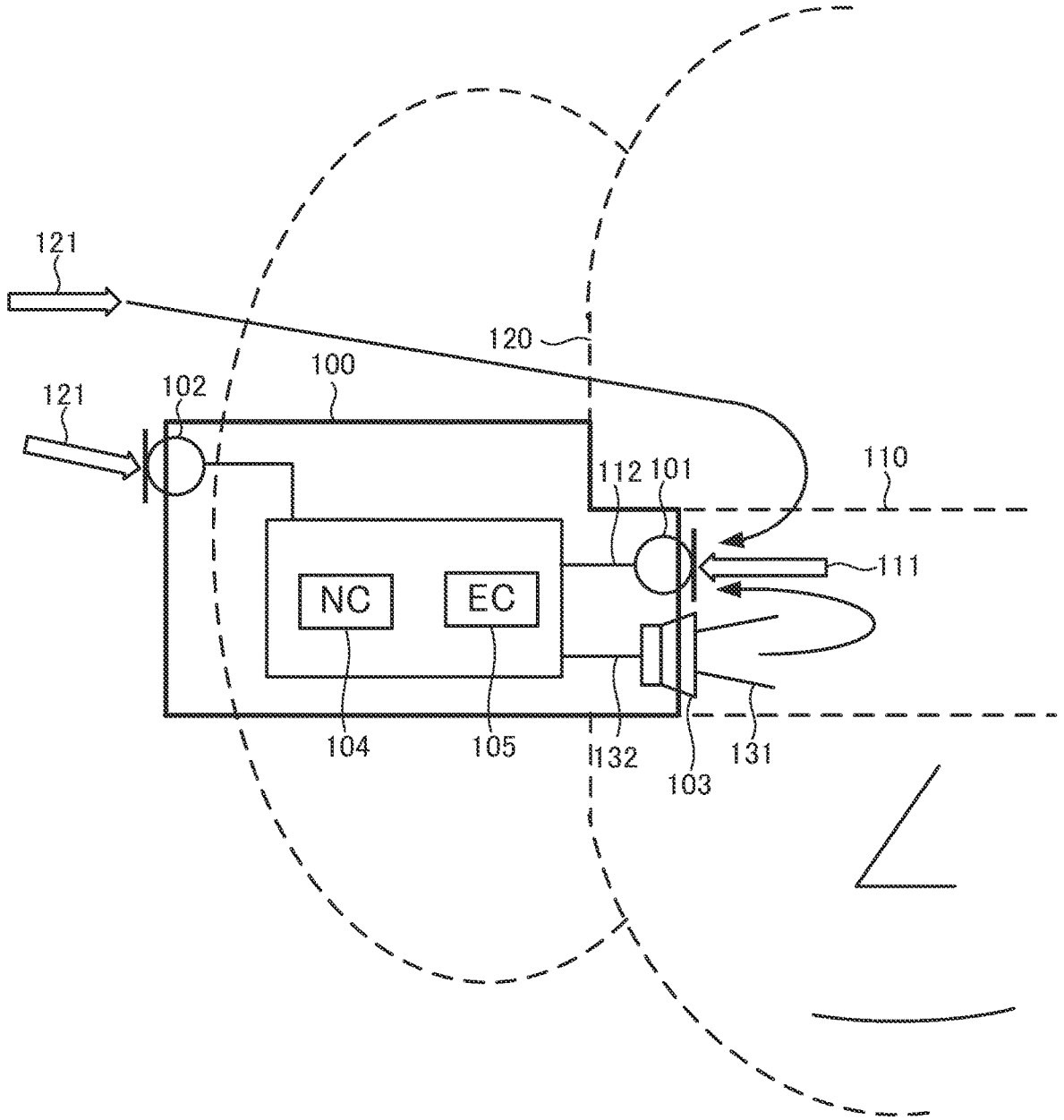
FIG. 1 is a block diagram showing the arrangement of a voice input/output apparatus according to the first example embodiment of the present invention.

Preferred example embodiments of the present invention will now be described in detail with reference to the drawings. It should be noted that the relative arrangement of the components, the numerical expressions and numerical values set forth in these example embodiments do not limit the scope of the present invention unless it is specifically stated otherwise. Further, in the drawings below, a unidirectional arrow simply indicates the flow direction of a given signal, and does not exclude bidirectionality. Note that the term "voice signal" in the following description refers to a direct electrical change which is generated in accordance with a voice or another sound and used to transmit the voice or the other sound, so this is not limited to a voice.

First Example Embodiment

A voice input/output apparatus 100 according to the first example embodiment of the present invention will be described with reference to FIG. 1.

As shown in FIG. 1, the voice input/output apparatus 100 includes a main voice acquirer 101, a noise acquirer 102, a voice output unit 103, a noise canceler 104, and an echo canceler 105. The noise acquirer 102 is arranged toward the outside of the body of a user 120, and acquires (captures) external noise 121 arriving from the outside of the user 120. The voice output unit 103 accepts an input of a voice signal 132, and outputs a voice 131 to an ear canal 110 of the user 120. The main voice acquirer 101 acquires (captures) a mixed voice, in which the external noise 121, the output voice 131, and a main voice 111 of the user 120 transmitted from the vocal cord of the user 120 through the ear canal are mixed, and outputs a mixed voice signal 112. The noise canceler 104 processes the mixed voice signal 112 using a noise signal based on the external noise 121. The echo canceler 105 processes the mixed voice signal 112 using the voice signal 132.

According to this example embodiment, it is possible to generate a high-quality main voice signal by performing both the noise cancellation and the echo cancellation.

Second Example Embodiment

Figure 2A:
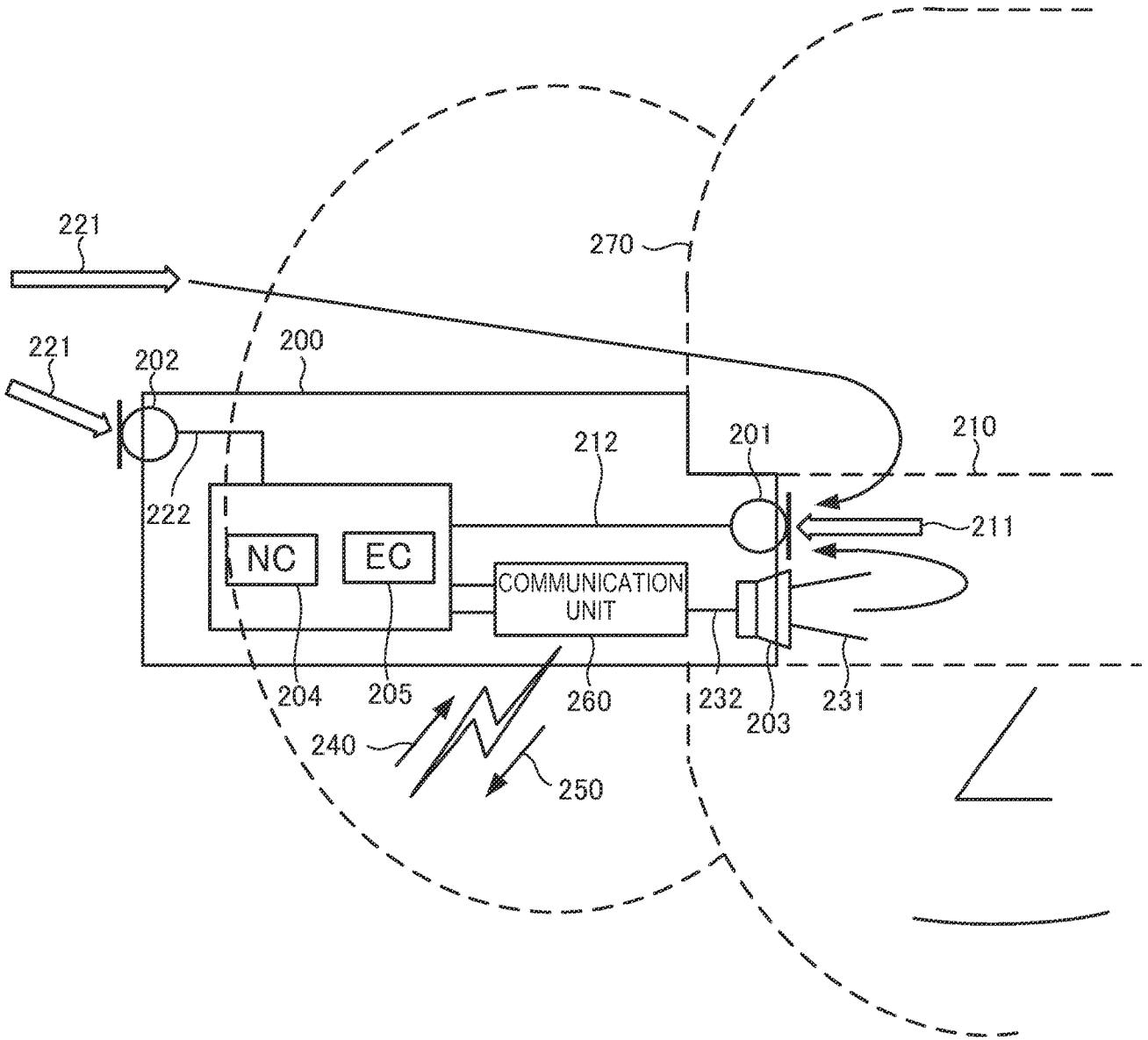
FIG. 2A is a view showing the arrangement of a voice input/output apparatus according to the second example embodiment of the present invention.

Next, a voice input/output apparatus according to the second example embodiment of the present invention will be described with reference to FIGS. 2A to 2C. FIG. 2A is a view showing the arrangement of the voice input/output apparatus according to this example embodiment. A voice input/output apparatus 200 includes an internal microphone 201 serving as a main voice acquirer, an external microphone 202 serving as a noise acquirer, a loudspeaker 203 serving as a voice output unit, and a voice processor 290. The voice processor 290 includes a noise canceler 204 and an echo canceler 205. The voice input/output apparatus 200 may be an inner ear headphone, a canal headphone, a binaural headphone, a one-ear headphone, or a monaural headphone, but the present invention is not limited thereto. Further, the voice input/output apparatus 200 is not limited to the headphone, but may be an earphone or a headset.

The internal microphone 201 is an internal microphone arranged toward an ear canal 210 of a user 270. A main voice 211 of the user 270 captured by the internal microphone 201 is transmitted to a predetermined transmission destination as a transmission signal 250.

The internal microphone 201 captures a mixed voice, in which external noise 221, an output voice 231, and the main voice 211 are mixed, and outputs a mixed voice signal 212. Even when the internal microphone 201 is arranged in the ear canal 210 as a confined space, if the external noise 221 is loud, the internal microphone 201 captures a part of the external noise 221 having passed through the head of the user 270 and propagated into the ear canal. Further, if the loudspeaker 203 is outputting a voice, the internal microphone 201 also captures the voice.

The external microphone 202 is arranged toward the outside of the body of the user 270. The external microphone 202 captures the external noise 221 arriving from the outside of the user 270. For example, the external microphone 202 is an external microphone that captures the external noise 221 around the user 270. The external microphone 202 captures the external noise 221 and generates an external noise signal 222.

A reception signal 240 received by a communication unit 260 is converted into an output voice signal 232 and input to the loudspeaker 203. The loudspeaker 203 accepts an input of the output voice signal 232, and outputs the output voice 231 to the ear canal 210 of the user 270.

The noise canceler 204 processes, using a noise signal based on the external noise 221 captured by the external microphone 202, the mixed voice signal 212 output from the mixed voice captured by the internal microphone 201. The internal microphone 201 captures the mixed voice in which the main voice 211 of the user 270 and the external noise 221 are mixed.

The echo canceler 205 performs, using the output voice signal 232 input to the loudspeaker 203, echo cancellation processing on the mixed voice signal 212 output by the internal microphone 201.

The communication unit 260 receives the reception signal 240, and sends the output voice signal 232 to the loudspeaker 203. The communication unit 260 also receives a voice signal generated by the voice processor 290, and transmits it to the outside as the transmission signal 250.

Figure 2B:
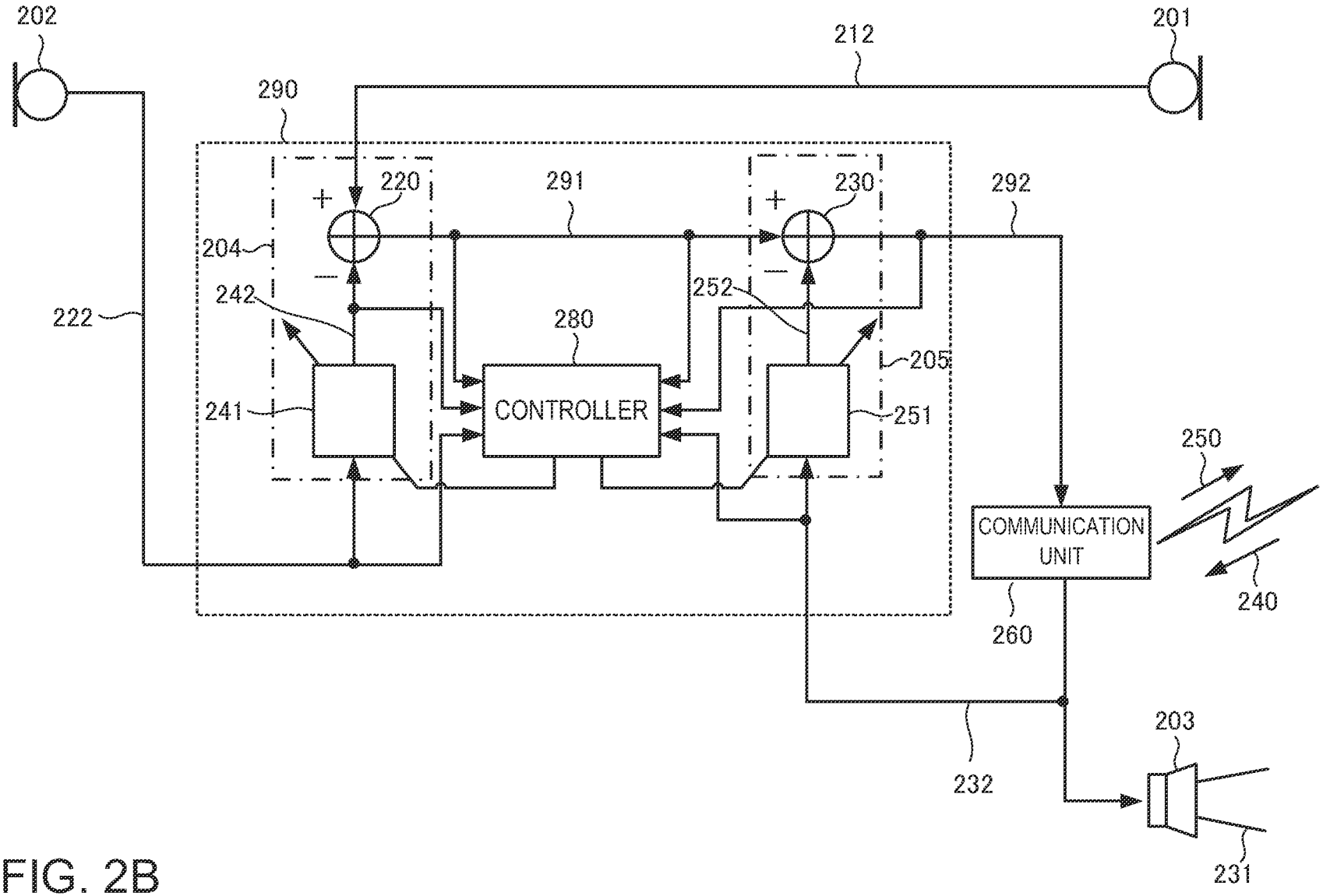
FIG. 2B is a view showing the detailed arrangement of a voice processor of the voice input/output apparatus according to the second example embodiment of the present invention.

FIG. 2B is a view showing the detailed arrangement of the voice processor of the voice input/output apparatus according to this example embodiment. The noise canceler 204 includes an adaptive filter 241 and an adder 220. The external noise signal 222 generated by the external microphone 202 is input to the noise canceler 204. The noise canceler 204 uses the external noise signal 222 based on the input external noise 221 to process the mixed voice signal 212. The noise canceler 204 drives the adaptive filter 241 to generate a pseudo signal (pseudo noise signal 242) of the noise signal included in the mixed voice signal. The adder 220 subtracts the pseudo noise signal 242 from the mixed voice signal 212 output by the internal microphone 201, thereby suppressing the noise. A pseudo main voice signal 291 output from the adder 220 includes residual noise, and this is utilized to update the coefficient of the adaptive filter 241.

The external noise signal 222 generated based on the external noise 221 captured by the external microphone 202 is also input to a controller 280. Based on the input external noise signal 222, the controller 280 controls the processing performed by the noise canceler 204. The external noise signal 222, the pseudo noise signal 242, and the pseudo main voice signal 291 are input to the controller 280. Based on these signals, the controller 280 generates a coefficient of the adaptive filter 241, and controls the coefficient update timing.

The pseudo main voice signal 291 is input to the echo canceler 205. The echo canceler 205 performs, using the output voice signal 232 input to the loudspeaker 203, echo cancellation processing on the mixed voice signal 212 output by the internal microphone 201. The echo canceler 205 includes an adaptive filter 251 and an adder 230. The adaptive filter 251 generates a pseudo echo signal 252 using the output voice signal 232. The adder 230 subtracts the pseudo echo signal 252 from the pseudo main voice signal 291 to generate a pseudo main voice signal 292. The output voice signal 232 and the pseudo main voice signals 291 and 292 are input to the controller 280. Based on these signals, the controller 280 generates a coefficient of the adaptive filter 251, and controls the coefficient update timing.

In order to remove a part of the output voice signal 232 mixed in the mixed voice signal 212 captured by the internal microphone 201, the echo canceler 205 performs the echo cancellation processing on the mixed voice signal 212 using the input voice signal.

In this manner, the echo canceler 205 performs the echo cancellation processing on the voice signal having undergone the noise cancellation processing. For example, even in a case in which the user utters a voice while the loudspeaker 203 is playing music, the echo canceler 205 can clearly extract the voice of the user from the mixed voice signal captured by the internal microphone 201.

The communication unit 260 accepts the pseudo main voice signal 292 having undergone the processing by the noise canceler and the echo canceler, and transmits it to the outside as the transmission signal 250.

Figure 2C:
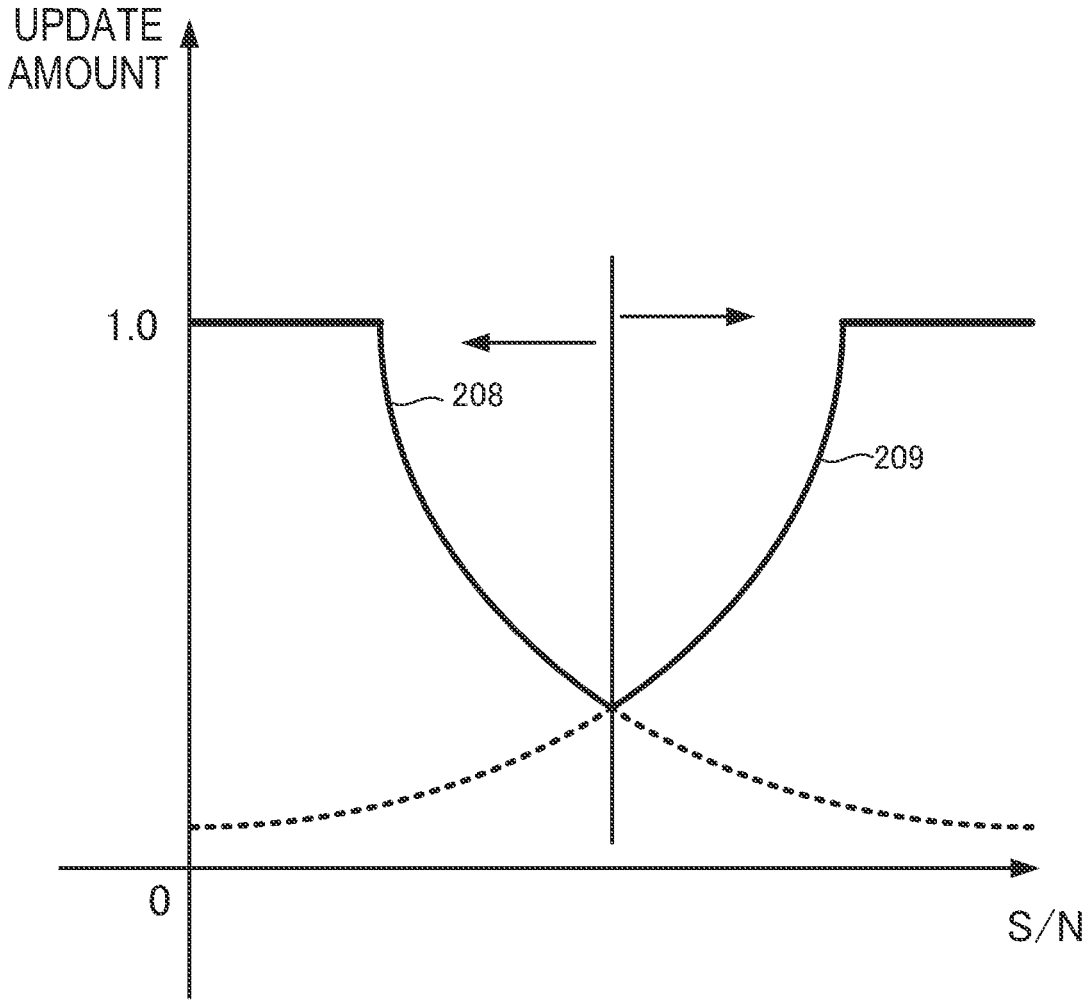
FIG. 2C is a graph for explaining coefficient processing of a controller of the voice input/output apparatus according to the second example embodiment of the present invention.

FIG. 2C is a graph for explaining coefficient processing of the controller 280 of the voice input/output apparatus 200 according to this example embodiment. As has been described above, the noise canceler 204 performs the noise cancellation processing using the adaptive filter 241, and the echo canceler 205 performs the echo cancellation processing using the adaptive filter 251. In FIG. 2C, the ordinate represents the update amount (amount of leaning), and the abscissa represents the S/N (signal to noise ratio). A graph 208 indicates the update amount of the coefficient of the adaptive filter 241 of the noise canceler 204. A graph 209 indicates the update amount of the coefficient of the adaptive filter 251 of the echo canceler 205. As indicated by the graph 208 and the graph 209, the controller 280 performs update processing of the adaptive filter 241, and does not update the adaptive filter 251 until the update processing of the adaptive filter 241 converges. That is, the controller 280 performs update processing of the adaptive filter 251 after the update processing of the adaptive filter 241 has converged. That is, while the controller 280 is performing update processing of one of the adaptive filters, it does not perform update processing of the other adaptive filter, so both the adaptive filters 241 and 251 are never updated at the same time. Not the noise canceler 204 and the echo canceler 205 are turned on/off, but the updates (learning) of the adaptive filters 241 and 251 are turned on/off, so that the adaptive filters 241 and 251 are alternately updated. After the adaptive filters 241 and 251 are updated to some extent, each filter coefficient hardly changes. When reaching such a state, the filter coefficients of the adaptive filters 241 and 251 are determined, so the controller 280 does not reupdate the adaptive filters 241 and 251 in principle.

The controller 280 updates the adaptive filter 241 at a timing at which the internal microphone 201 does not capture the main voice 211 and the loudspeaker 203 is not outputting the output voice 231. The controller 280 updates the adaptive filter 251 at a timing at which the loudspeaker 203 is outputting the output voice 231.

At a timing at which the internal microphone 201 captures the main voice 211 and the loudspeaker 203 is outputting the output voice 231, the controller 280 does not update the adaptive filters 241 and 251.

According to this example embodiment, it is possible to transmit a high-quality main voice signal by performing both the noise cancellation and the echo cancellation. That is, it is possible to deliver the clear voice of the user to the partner. In addition, since the adaptive filters are updated, it is possible to cope with a change in external noise and a change in voice output from the loudspeaker. Further, also in a case in which, for example, the voice of the user is transmitted to a smartphone for voice recognition by an AI (Artificial Intelligence) assistant, the recognition accuracy is increased, so that misrecognition by the AI assistant can be reduced even outdoors with large external noise. Furthermore, it is possible to implement that the user makes a voice call or uses the AI assistant even while listening to music using a headphone.

Third Example Embodiment

Figure 3:
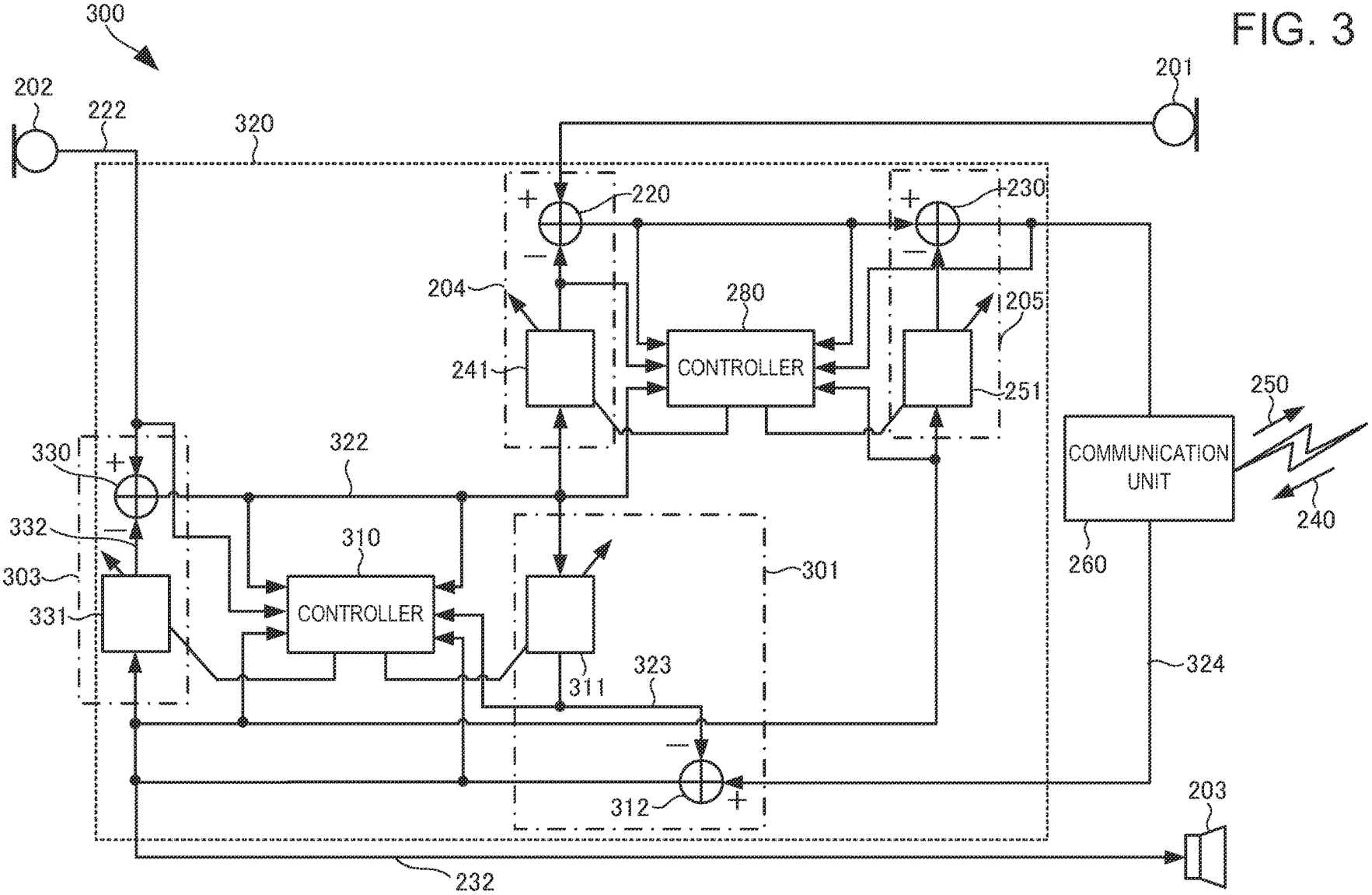
FIG. 3 is a view showing the arrangement of a voice input/output apparatus according to the third example embodiment of the present invention.

Next, a voice input/output apparatus according to the third example embodiment of the present invention will be described with reference to FIG. 3. FIG. 3 is a view showing the arrangement of the voice input/output apparatus according to this example embodiment. The voice input/output apparatus according to this example embodiment is different from that in the above-described second example embodiment in that the arrangement of a voice processor 320 is different from the arrangement of the voice processor 290. The remaining components and operations are similar to those in the second example embodiment. Hence, the same reference numerals denote the similar components and operations, and a detailed description thereof will be omitted.

In addition to the arrangement of the voice processor 290 in the second example embodiment, the voice processor 320 includes a noise canceler 301, an echo canceler 303, and a controller 310. The echo canceler 303 includes an adder 330 and an adaptive filter 331. In the echo canceler 303, the adder 330 subtracts, from an external noise signal 222 captured by an external microphone 202, a pseudo output voice 332 generated by the adaptive filter 331 from an output voice signal 232 of a loudspeaker 203. With this operation, sound leakage from the loudspeaker 203 is canceled, so that a high-quality pseudo external noise signal 322 can be obtained.

The external noise signal 222, the external noise signal 222 having undergone the echo cancellation processing, and the output voice signal 232 are input to the controller 310, and the controller 310 generates a coefficient of the adaptive filter 331 to control an update.

The noise canceler 301 includes an adder 312 and an adaptive filter 311. In the noise canceler 301, the adder 312 subtracts, from a voice signal 324 generated based on a reception signal 240, the pseudo noise signal 323 generated from the pseudo external noise signal 322.

According to this example embodiment, it is possible to transmit a high-quality main voice signal by performing both the noise cancellation and the echo cancellation. In addition, it is possible to remove the influence of the sound leakage output from the loudspeaker and mixed into the external microphone.

Fourth Example Embodiment

Figure 4:
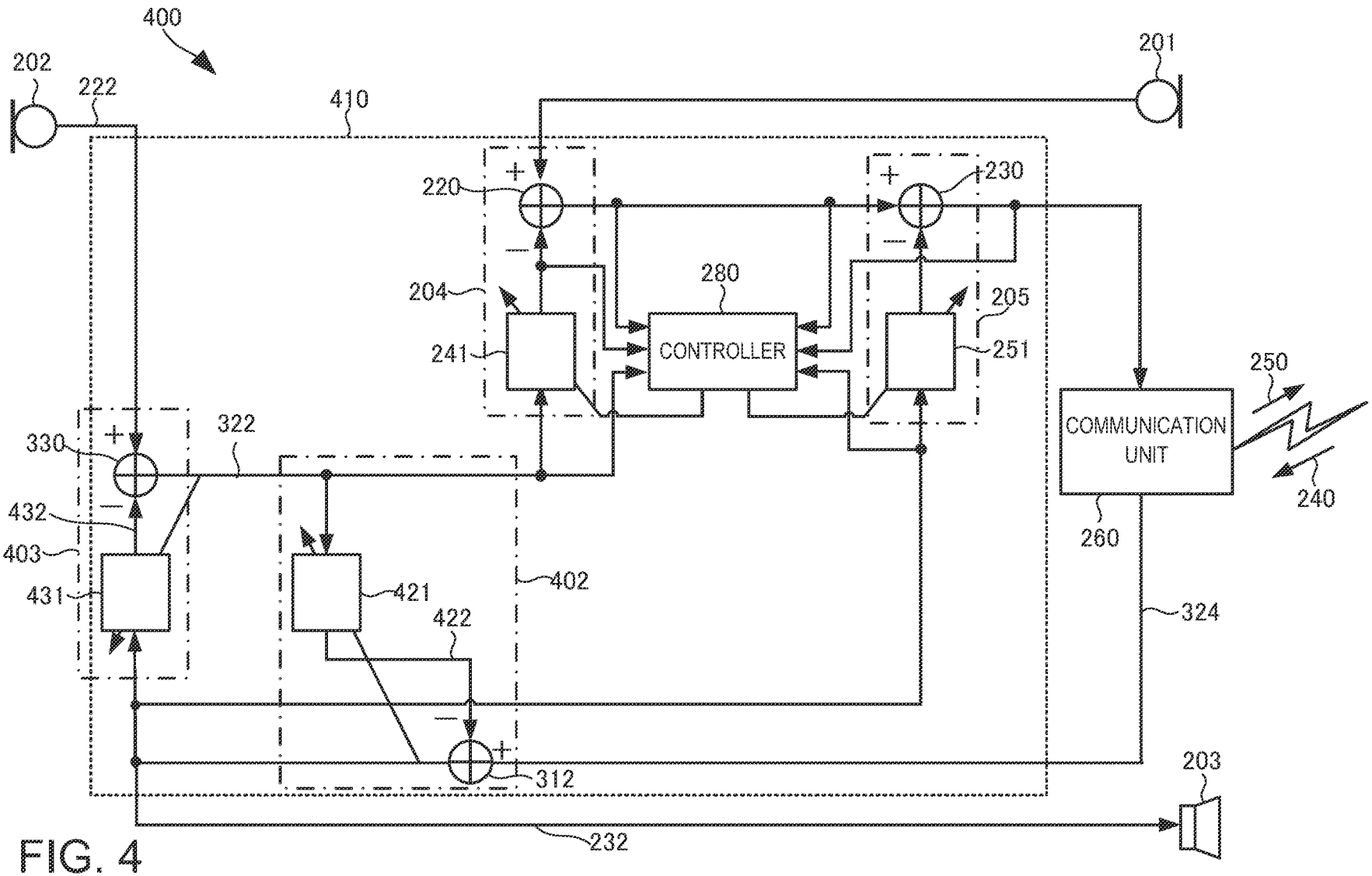
FIG. 4 is a view showing the arrangement of a voice input/output apparatus according to the fourth example embodiment of the present invention.

Next, a voice input/output apparatus according to the fourth example embodiment of the present invention will be described with reference to FIG. 4. FIG. 4 is a view for explaining the arrangement of a voice input/output apparatus 400 according to this example embodiment. The voice input/output apparatus 400 according to this example embodiment is different from the voice input/output apparatus 300 according to the above-described third example embodiment in that there is no controller 310. The remaining components and operations are similar to those in the second and third example embodiments. Hence, the same reference numerals denote the similar components and operations, and a detailed description thereof will be omitted.

An adaptive filter 421 generates a pseudo noise signal 422 from a pseudo external noise signal 322 having undergone echo cancellation, and an adder 312 subtracts the pseudo noise signal 422 from a voice signal 324 generated from a reception signal 240.

An echo canceler 403 includes an adaptive filter 431 and an adder 330. The adaptive filter 431 generates a pseudo output voice signal 432. The adder 330 subtracts the pseudo output voice signal 432 from an external noise signal 222.

According to this example embodiment, an effect similar to that in the third example embodiment can be obtained with the simpler arrangement.

Fifth Example Embodiment

Figure 5A:
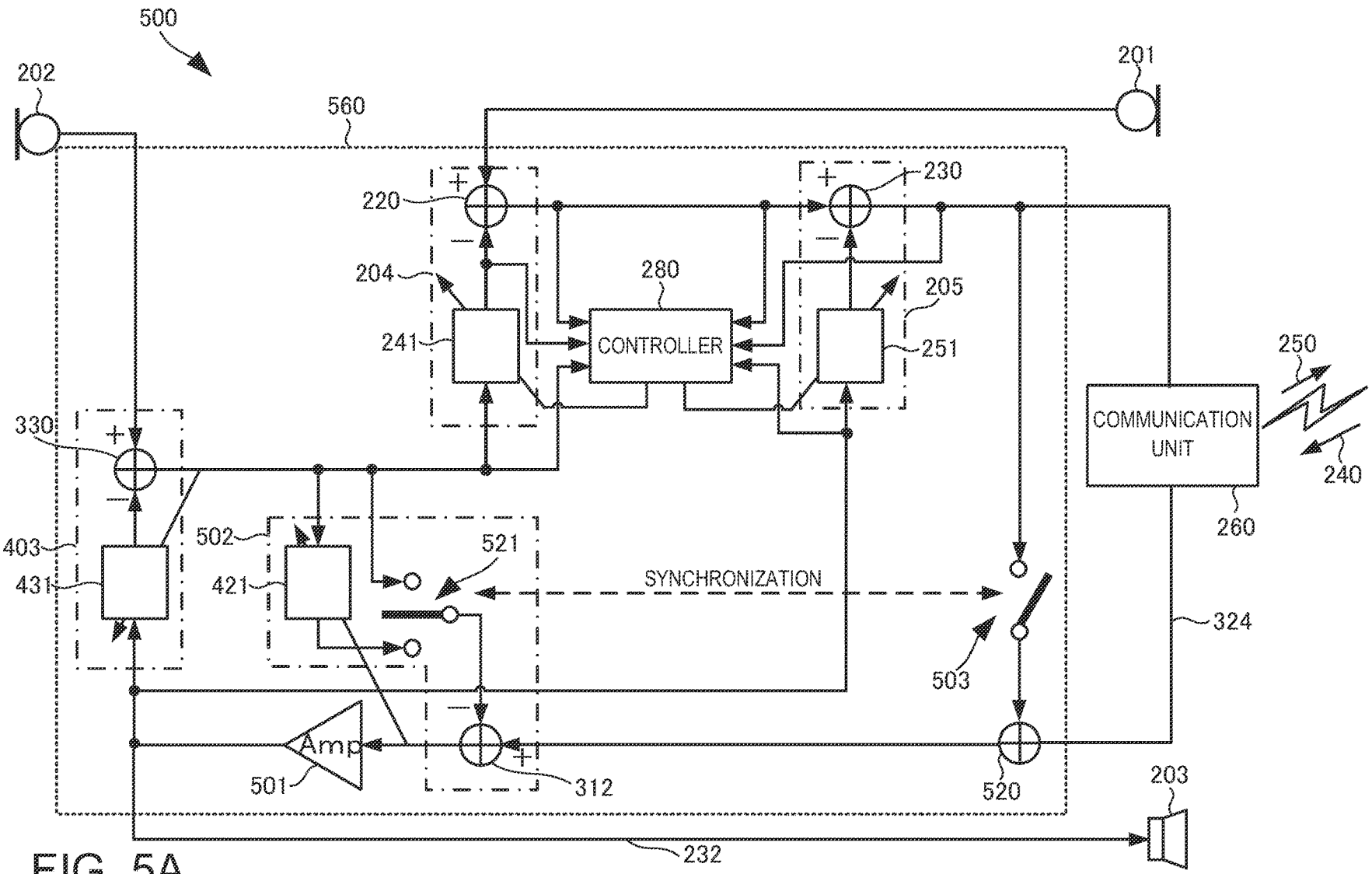
FIG. 5A is a view showing the arrangement of a hearing aid according to the fifth example embodiment of the present invention.
Figure 5B:
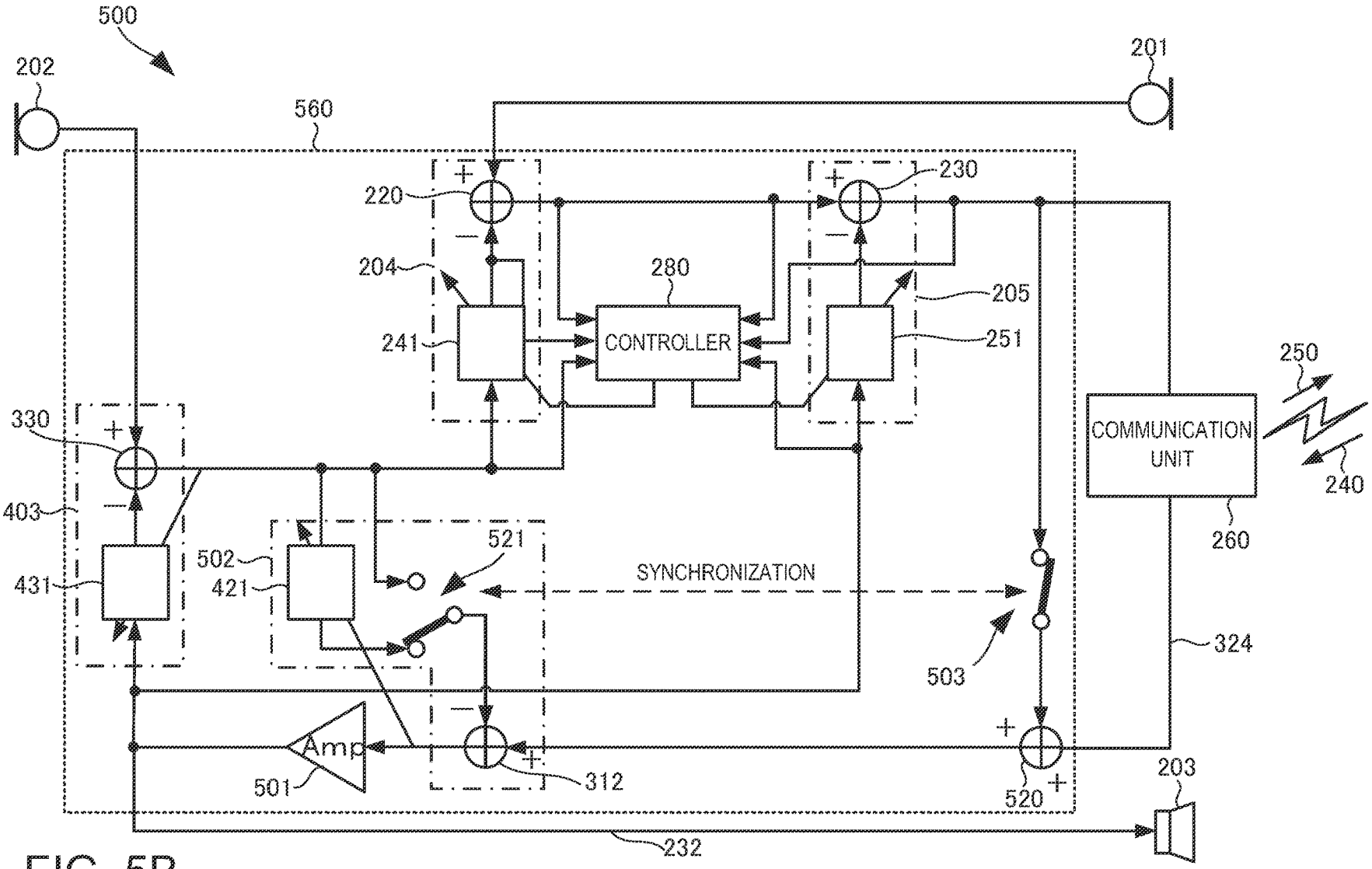
FIG. 5B is a view showing the arrangement of the hearing aid according to the fifth example embodiment of the present invention.
Figure 5C:
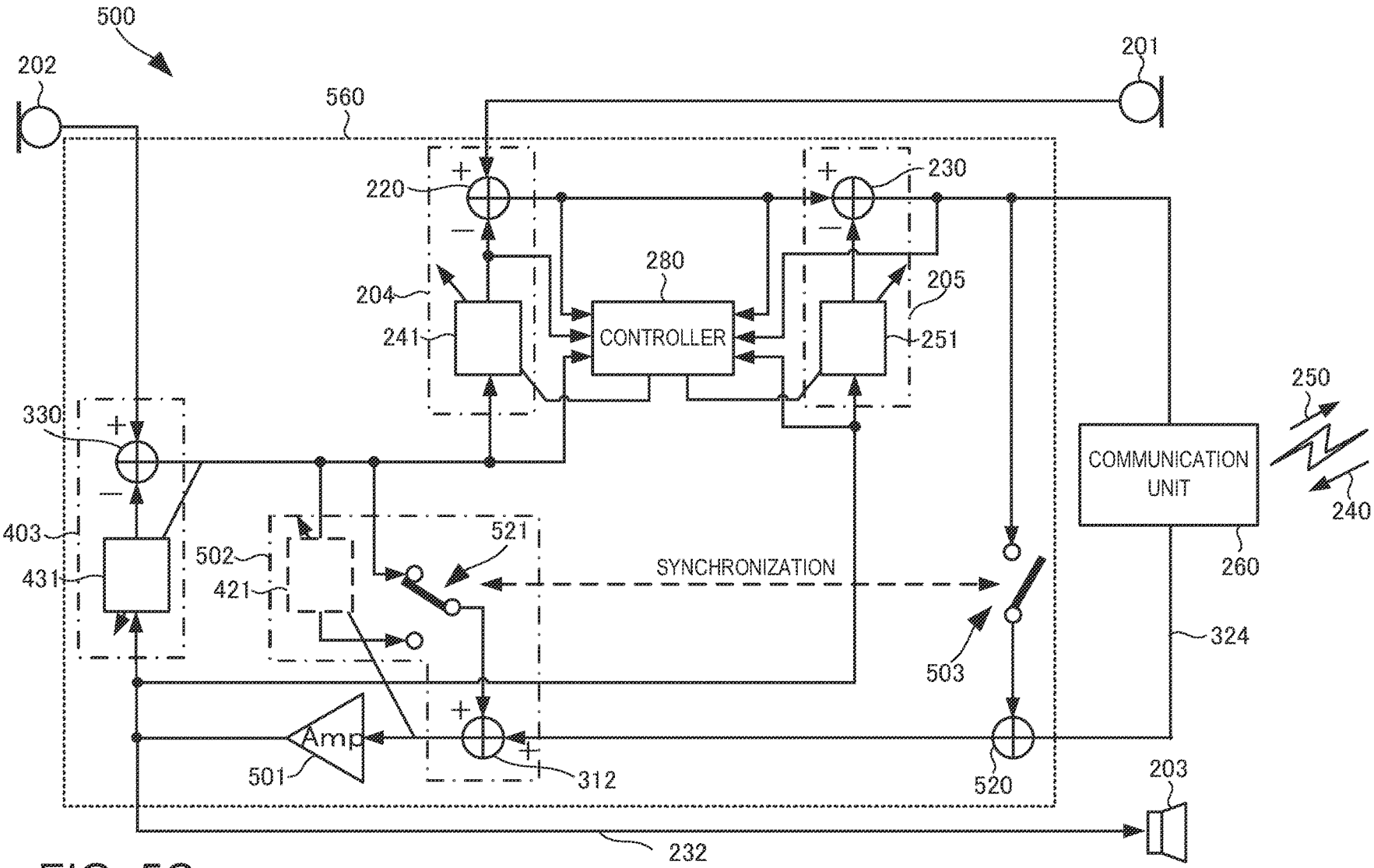
FIG. 5C is a view showing the arrangement of the hearing aid according to the fifth example embodiment of the present invention.

Next, a hearing aid according to the fifth example embodiment of the present invention will be described with reference to FIGS. 5A to 5C. FIGS. 5A to 5C are views showing the arrangement of the hearing aid according to this example embodiment. The hearing aid according to this example embodiment is different from the voice input/output apparatus according to the above-described fourth example embodiment in that a hearing aid function and switches are added. The remaining components and operations are similar to those in the fourth and example embodiments. Hence, the same reference numerals denote the similar components and operations, and a detailed description thereof will be omitted.

FIG. 5A shows a case in which while listening to the voice of a partner, leakage of external noise is allowed. As shown in FIG. 5A, a hearing aid 500 includes an internal microphone 201, an external microphone 202, a loudspeaker 203, a communication unit 260, and a voice processor 560. The voice processor 560 further includes an amplifier 501, switches 521 and 503, and an adder 520. A voice signal 324 corresponding to a reception signal 240 input via the communication unit 260 is amplified by the amplifier 501, input to the loudspeaker 203, and output as an output voice. In the hearing aid 500, since the output voice output from the loudspeaker 203 is loud, the mixing ratio of the output voice in the mixed voice is high. Therefore, the effect of performing cancelation on the output voice captured by the internal microphone 201 is large. In addition, since the amplified output voice easily leaks to the outside of the user from the hearing aid 500, an echo canceler 403 is very important. The user can hear the voice of the call partner at a loud volume. Even the hearing aid 500 can capture a high-quality main voice. On the other hand, although the internal microphone 201 easily captures the amplified output voice, a high-quality pseudo main voice signal can be generated by the operation of the echo canceler 205.

FIG. 5B shows a case in which while canceling the external noise, each of the self-voice and the voice of the partner is heard at a loud volume. In this case, the switch 521 is connected to the contact on the adaptive filter 421 side. In synchronization with the movement of the switch 521, the switch 503 is closed. The adaptive filter 421 and the adder 312 operate as described with reference to FIG. 4. With this operation, the user can hear the voice with the external noise canceled. In addition, since the switch 503 is closed, the adder 520 adds the pseudo main voice signal and the voice signal 324 generated from the reception signal 240. With this operation, a user 270 can hear the self-generated voice, which is called sidetone.

FIG. 5C shows a case in which the user hears each of the external noise and the voice of the partner at a loud volume. In this case, the switch 521 is connected to a contact on the opposite side of the noise canceler 302. Further, the switch 503 is opened in synchronization with the movement of the switch 521. The echo canceler 403 cancels the influence of sound leakage. The adder 312 adds the clear external noise and the received voice of the partner. The amplifier 501 amplifies the voice signal added by the amplifier 312 to generate an output voice signal 232. With this operation, the user can hear each of the external sound and the voice of the call partner at a loud volume.

Sixth Example Embodiment

Figure 6:
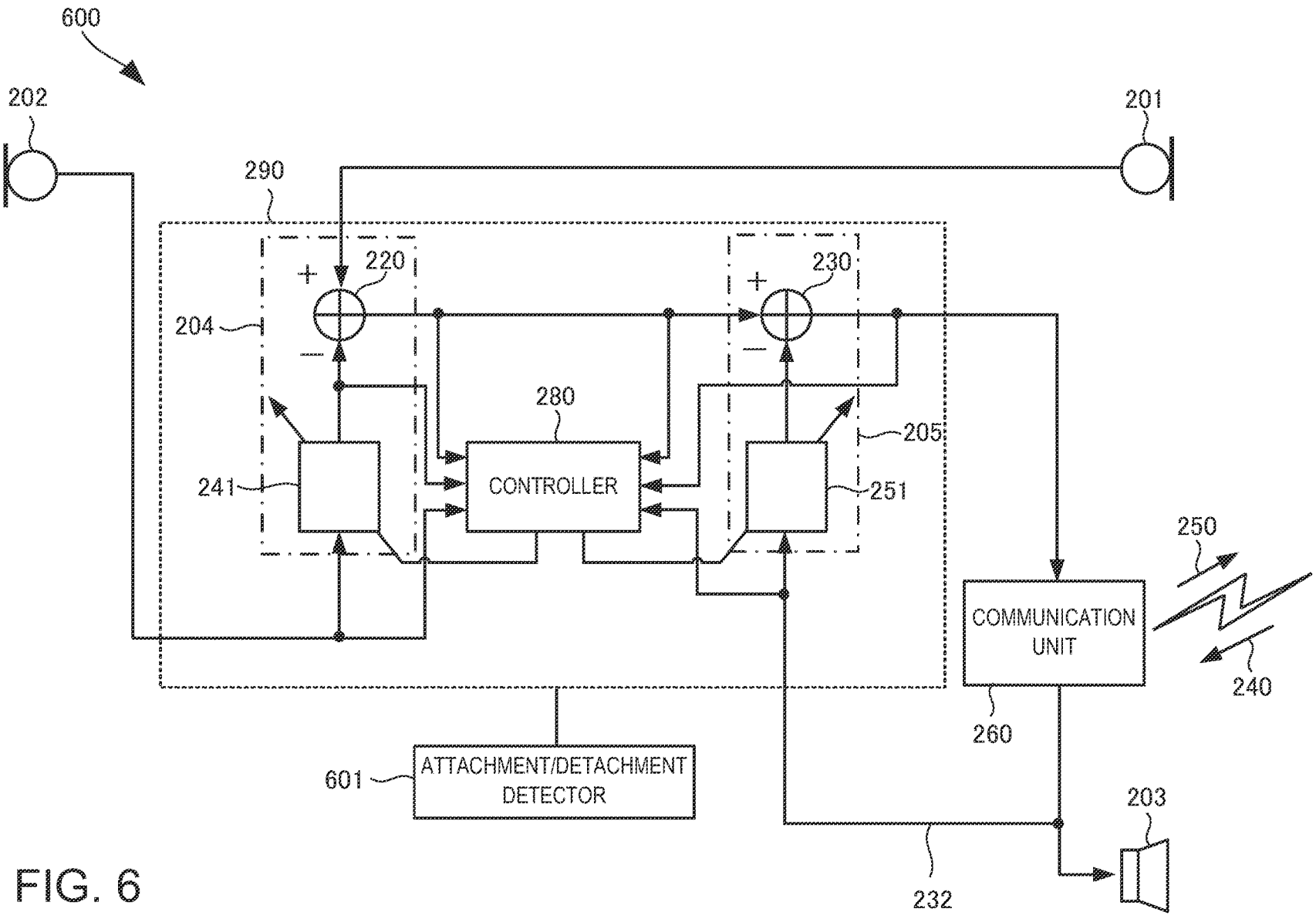
FIG. 6 is a view showing the arrangement of a voice input/output apparatus according to the sixth example embodiment of the present invention.

Next, a voice input/output apparatus according to the sixth example embodiment of the present invention will be described with reference to FIG. 6. FIG. 6 is a view showing the arrangement of the voice input/output apparatus according to this example embodiment. The voice input/output apparatus according to this example embodiment is different from that in the above-described second example embodiment in that an attachment and detachment detector 601 is provided. The remaining components and operations are similar to those in the second example embodiment. Hence, the same reference numerals denote the similar components and operations, and a detailed description thereof will be omitted.

The attachment and detachment detector 601 uses, for example, the blood flow sound or the heartbeat sound captured by an internal microphone 201 to detect attachment/detachment of a voice input/output apparatus 600 to/from the ear. Further, the attachment and detachment detector 601 may, for example, oscillate an ultrasonic wave inaudible to humans, and detect the attachment/detachment based on the presence/absence of a reflected wave of the ultrasonic wave. Furthermore, the attachment and detachment detector 601 may detect the attachment/detachment using an infrared sensor, an accelerometer, or the like. Note that the attachment/detachment detection method is not limited to these methods.

If the attachment and detachment detector 601 has detected attachment of the voice input/output apparatus 600, a noise canceler 204 performs noise cancellation processing using an adaptive filter 241, and an echo canceler 205 performs echo cancellation processing using an adaptive filter 251. The echo state changes for each user wearing the voice input/output apparatus 600, so that a controller 280 updates the adaptive filter 251 every time the attachment of the voice input/output apparatus 600 is detected. On the other hand, the noise state also changes for each attachment situation (location or time), so that the controller 280 updates the adaptive filter 241 every time the attachment is detected. According to this example embodiment, since the attachment/detachment detector is provided, even if the user who uses the voice input/output apparatus changes or the user refits the voice input/output apparatus, the quality of a transmission signal can be increased. Note that if it is detected by the attachment and detachment detector 601 that the voice input/output apparatus 600 has been detached, the voice input/output apparatus 600 may stop all functions of the voice input/output apparatus 600.

Seventh Example Embodiment

Figure 7:
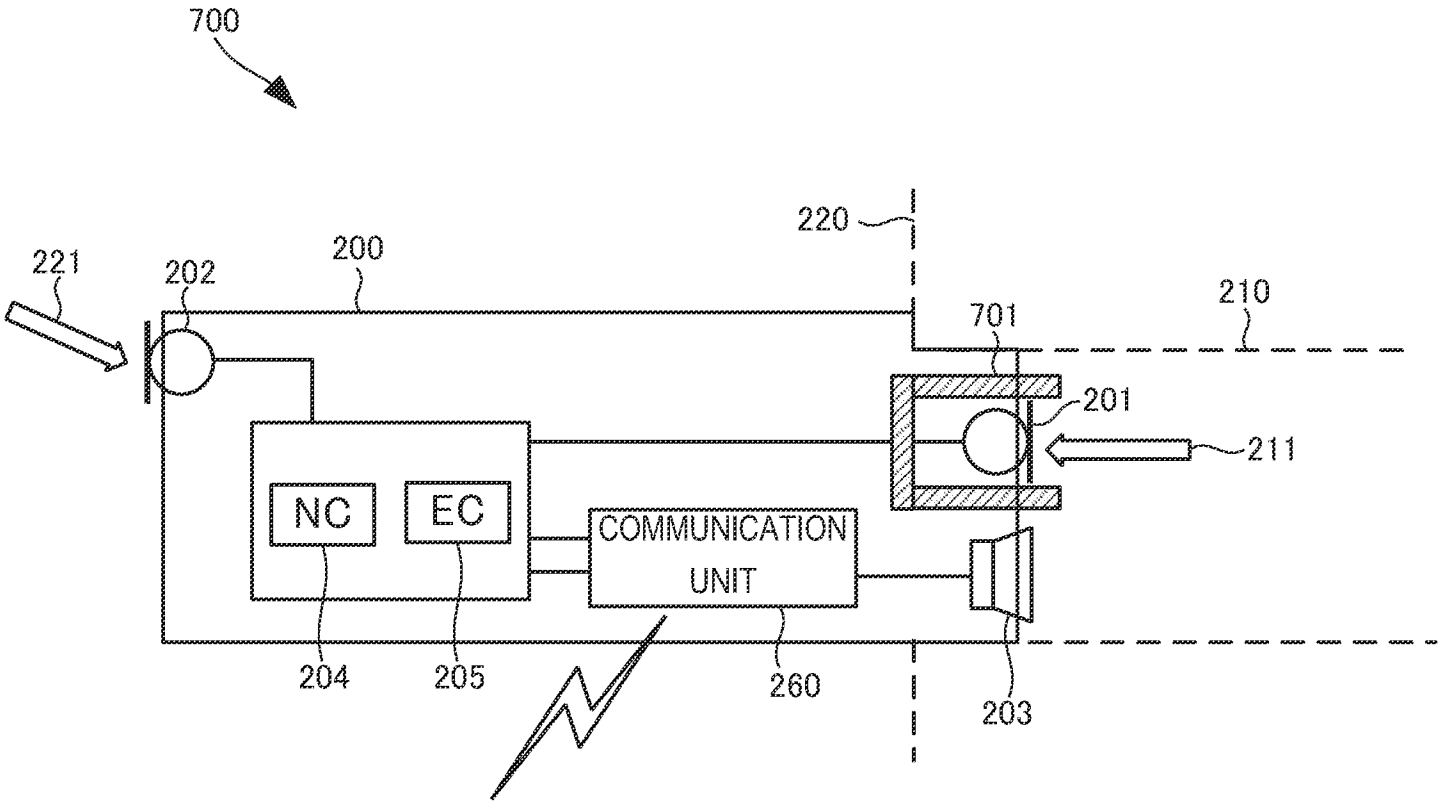
FIG. 7 is a view showing the arrangement of a voice input/output apparatus according to the seventh example embodiment of the present invention.

Next, a voice input/output apparatus according to the seventh example embodiment of the present invention will be described with reference to FIG. 7. FIG. 7 is a view showing the arrangement of the voice input/output apparatus according to this example embodiment. The voice input/output apparatus according to this example embodiment is different from that in the above-described second example embodiment in that a sound insulator is provided. The remaining components and operations are similar to those in the second example embodiment. Hence, the same reference numerals denote the similar components and operations, and a detailed description thereof will be omitted.

A sound insulator 701 limits the intrusion route of external noise 221 to an internal microphone 201. The sound insulator is, for example, a cylindrical member surrounding the internal microphone 201. So as not to insulate a main voice 211 that arrives through an ear canal 210 of a user 270, the side of the sound insulator 701 facing the ear canal 210 of the user 270 is open. Note that the shape of the sound insulator 701 is not limited to the shape described here, and any shape may be used as long as the external noise 221 transmitted through the body of the user 270 or a voice input/output apparatus 700 can be insulated. Further, the material of the sound insulator 701 may be any material as long as the sound insulator 701 functions as a member capable of insulating the external noise 221. For example, rubber, a resin, glass, or the like can be employed. According to this example embodiment, since a noise canceler 204, an echo canceler 205, and the sound insulator 701 are provided, a high-quality pseudo main voice signal can be generated.

Other Example Embodiments

While the invention has been particularly shown and described with reference to example embodiments thereof, the invention is not limited to these example embodiments. It will be understood by those of ordinary skill in the art that various changes in form and details may be made therein without departing from the spirit and scope of the present invention as defined by the claims. A system or apparatus including any combination of the individual features included in the respective example embodiments may be incorporated in the scope of the present invention.

The present invention is applicable to a system including a plurality of devices or a single apparatus. The present invention is also applicable even when an information processing program for implementing the functions of example embodiments is supplied to the system or apparatus directly or from a remote site. Hence, the present invention also incorporates the program installed in a computer to implement the functions of the present invention by the computer, a medium storing the program, and a WWW (World Wide Web) server that causes a user to download the program. Especially, the present invention incorporates at least a non-transitory computer readable medium storing a program that causes a computer to execute processing steps included in the above-described example embodiments.

Figure 8A:
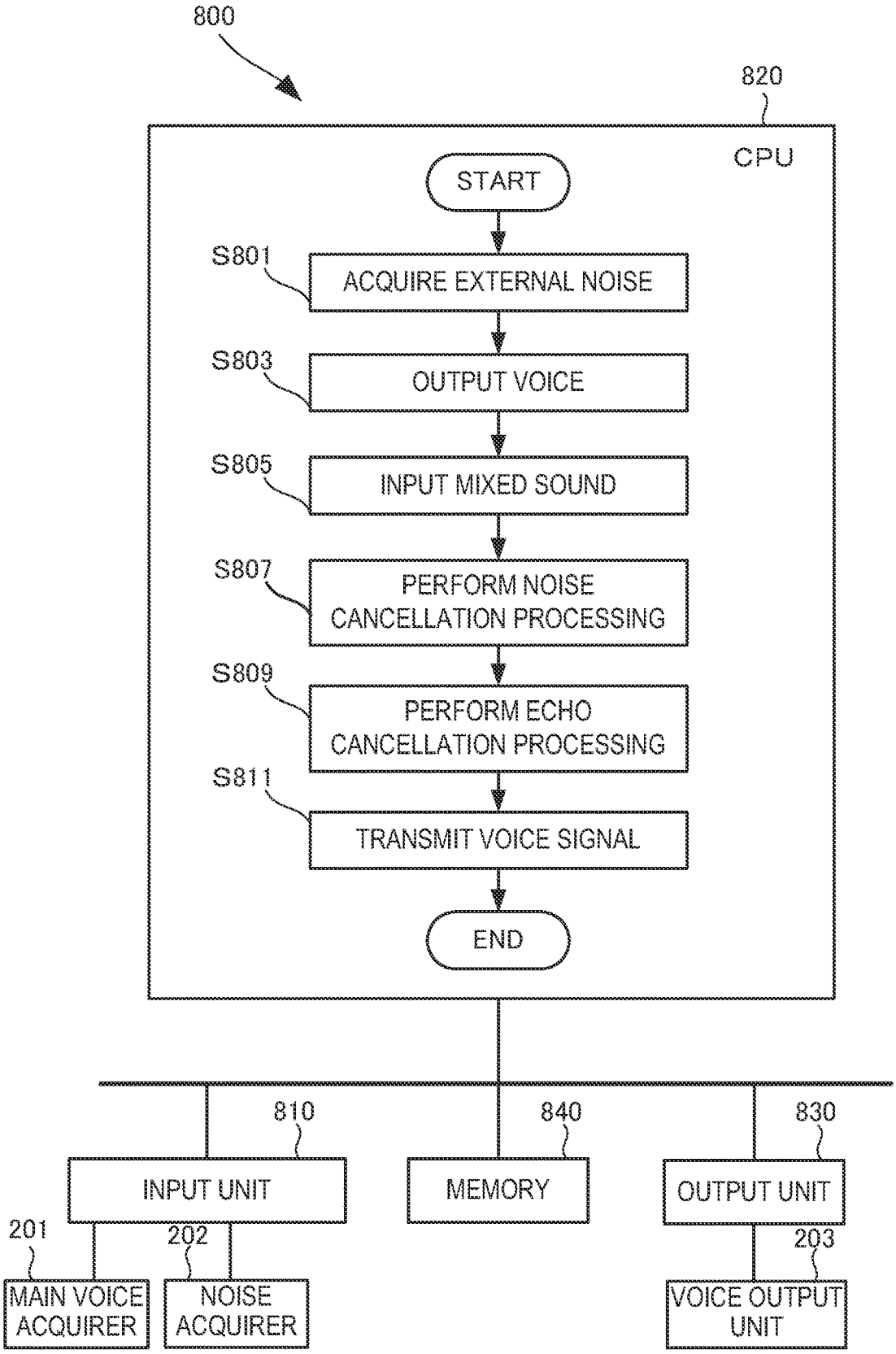
FIG. 8A is a view showing the configuration of a computer that executes a signal processing program when the second example embodiment is formed by the signal processing program.

FIG. 8A is a block diagram showing the configuration of a computer 800 that executes a signal processing program when the second example embodiment is formed by the signal processing program. The computer 800 includes an input unit 810, a CPU (Central Processing Unit) 820, an output unit 830, and a memory 840.

The CPU 820 controls an operation of the computer 800 by reading the signal processing program stored in the memory 840. That is, the CPU 820 executing the signal processing program captures external noise 221 of the user from the input unit 810 in step S801. In step S803, the CPU 820 outputs a voice signal from the output unit 830. In step S805, the CPU 820 captures, from the input unit 810, a mixed voice signal 212 in which the external noise 221, a main voice 211, and an output voice 231 from a voice output unit are mixed. In step S807, the CPU 820 performs noise cancellation processing on the captured mixed voice signal 212. In step S809, the CPU 820 uses a voice signal input to a loudspeaker 203 to perform echo cancellation processing on the captured mixed voice signal 212. In step S811, the CPU 820 transmits a voice signal.

Figure 8B:
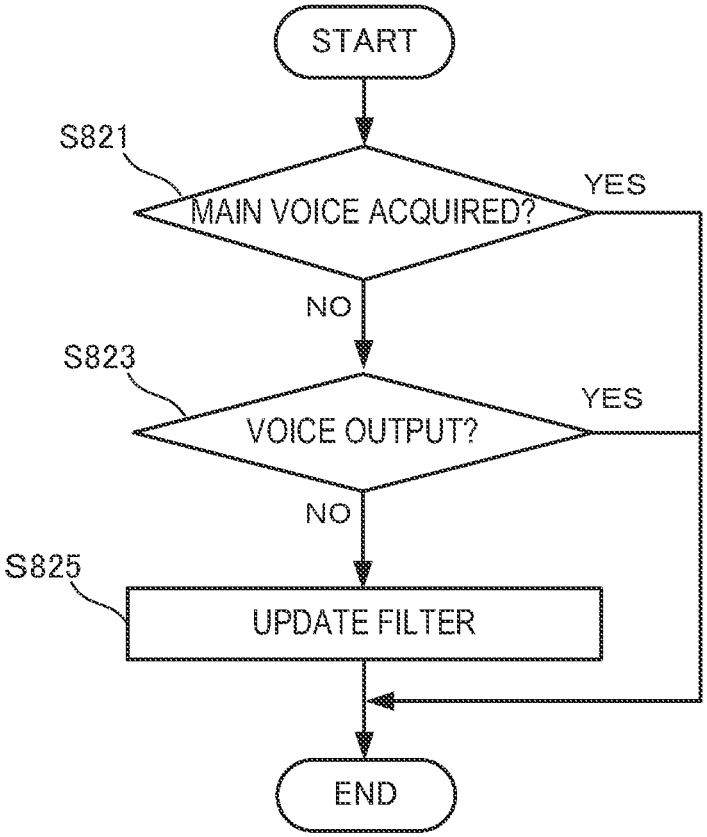
FIG. 8B is a flowchart illustrating the procedure of processing performed by a CPU 820.

FIG. 8B is a flowchart illustrating the procedure of processing performed by the CPU 820. In step S821, the CPU 820 determines whether the mixed voice signal 212 is captured by the internal microphone 201. If it is determined that the mixed voice signal 212 is captured (YES in step S821), the CPU 820 terminates the processing. If it is determined that no mixed voice signal 212 is captured (NO is step S821), the CPU 820 advances to step S823. In step S823, the CPU 820 determines whether the output voice 231 is being output from the loudspeaker 203. If it is determined that the output voice 231 is being output (YES in step S823), the CPU 820 terminates the processing. If it is determined that no output voice 231 is being output (NO in step S823), the CPU 820 advances to step S825. In step S825, the CPU 820 updates an adaptive filter 241 of a noise canceler 204.

Figure 8C:
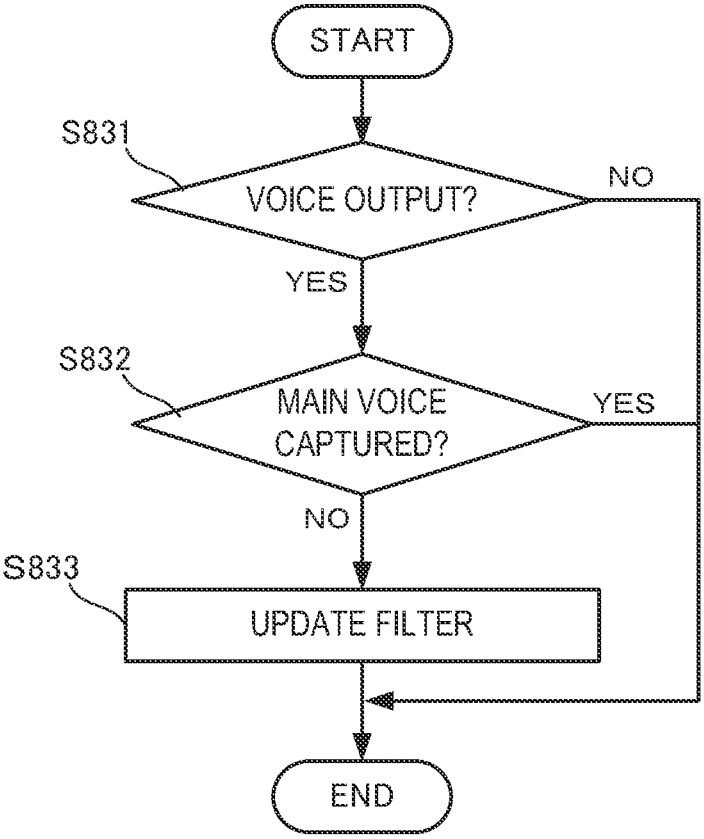
FIG. 8C is a flowchart illustrating the procedure of processing performed by the CPU 820.

FIG. 8C is a flowchart illustrating the procedure of processing performed by the CPU 820. In step S831, the CPU 820 determines whether the output voice 231 is being output from the loudspeaker 203. If it is determined that no output voice 231 is being output (NO in step S831), the CPU 820 terminates the processing. If it is determined that the output voice 231 is being output (YES in step S831), the CPU 820 advances to step S832. In step S832, the CPU 820 determines whether the main voice is captured. If it is determined that the main voice is captured (YES in step S832), the CPU 820 terminates the processing. If it is determined that the main voice is not captured (NO in step S832), the CPU 820 advances to step S833. In step S833, the CPU 820 updates an adaptive filter (251) of an echo canceler 205.

Figure 8D:
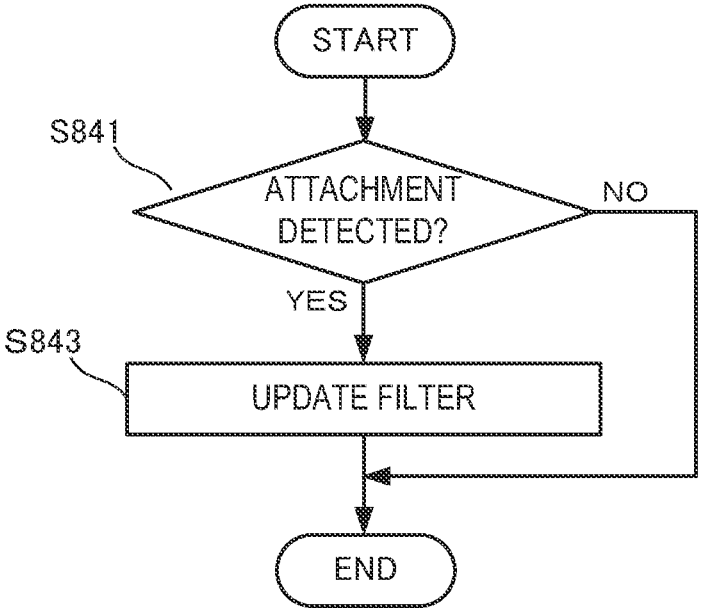
FIG. 8D is a flowchart illustrating the procedure of processing performed by the CPU 820.

FIG. 8D is a flowchart illustrating the procedure of processing performed by the CPU 820. In step S841, the CPU 820 determines whether attachment of a voice input/output apparatus 600 is detected. If it is determined that the attachment is not detected (NO in step S841), the CPU 820 terminates the processing. If it is determined that the attachment is detected (YES in step S841), the CPU 820 advances to step S843. In step S843, the CPU 820 updates the adaptive filter 251 of the echo canceler 205.

Other Expressions of Example Embodiments

Some or all of the above-described example embodiments can also be described as in the following supplementary notes but are not limited to the followings.

(Supplementary Note 1)

There is provided a voice input/output apparatus comprising:

a noise acquirer that is arranged toward an outside of a body of a user and acquires external noise arriving from the outside of the user;

a voice output unit that accepts an input of a voice signal and outputs a voice to an ear canal of the user;

a main voice acquirer that acquires a mixed voice, in which the external noise, the output voice, and a main voice of the user transmitted from a vocal cord of the user through the ear canal are mixed, and outputs a mixed voice signal;

a noise canceler that processes the mixed voice signal using a noise signal based on the external noise; and an echo canceler that processes the mixed voice signal using the voice signal.

(Supplementary Note 2)

In the voice input/output apparatus according to Supplementary Note 1, the echo canceler performs echo cancellation processing on a voice signal on which noise cancellation processing has been performed in the noise canceler.

(Supplementary Note 3)

In the voice input/output apparatus according to Supplementary Note 1 or 2, the noise canceler performs noise cancellation processing using a first adaptive filter, the echo canceler performs echo cancellation processing using a second adaptive filter, the second adaptive filter is not updated when the first adaptive filter is updated, and the first adaptive filter is not updated when the second adaptive filter is updated.

(Supplementary Note 4)

In the voice input/output apparatus according to Supplementary Note 3, the noise canceler updates the first adaptive filter at a timing at which the main voice acquirer does not acquire the main voice and the voice output unit is not outputting the voice.

(Supplementary Note 5)

In the voice input/output apparatus according to Supplementary Note 3 or 4, the echo canceler updates the second adaptive filter at a timing at which the voice output unit is outputting the voice.

(Supplementary Note 6)

In the voice input/output apparatus according to Supplementary Note 4 or 5, the noise canceler and the echo canceler do not update the first adaptive filter and the second adaptive filter at a timing at which the main voice acquirer acquires the main voice and the voice output unit is outputting the voice.

(Supplementary Note 7)

In the voice input/output apparatus according to Supplementary Note 1, the noise canceler performs, using the external noise acquired by the noise acquirer, noise cancellation processing on the mixed voice signal on which echo cancellation processing has been performed in the echo canceler.

(Supplementary Note 8)

The voice input/output apparatus according to any one of Supplementary Notes 1 to 7 further comprises a sound insulator that limits an intrusion route of the external noise to the main voice acquirer.

(Supplementary Note 9)

The voice input/output apparatus according to any one of Supplementary Notes 1 to 8 further comprises an attachment and detachment detector that detects attachment and detachment of the voice input/output apparatus, wherein the noise canceler performs noise cancellation processing using a first adaptive filter, and the echo canceler performs echo cancellation processing using a second adaptive filter, and when the attachment and detachment detector has detected attachment of the voice input/output apparatus, at least one of the first adaptive filter and the second adaptive filter is updated.

(Supplementary Note 10)

The voice input/output apparatus according to any one of Supplementary Notes 1 to 8 further comprises a communication unit that transmits the mixed voice signal processed by both the noise canceler and the echo canceler.

(Supplementary Note 11)

There is provided a hearing aid comprising:

a noise acquirer that is arranged toward an outside of a body of a user and acquires external noise arriving from the outside of the user;

a voice output unit that accepts an input of a voice signal and outputs a voice to an ear canal of the user;

a main voice acquirer that acquires a mixed voice, in which the external noise, the output voice, and a main voice of the user transmitted from a vocal cord of the user through the ear canal are mixed, and outputs a mixed voice signal;

a noise canceler that processes the mixed voice signal using a noise signal based on the external noise;

an echo canceler that processes the mixed voice signal using the voice signal; and an amplifier that amplifies the voice signal to be input to the voice output unit.

(Supplementary Note 12)

There is provided a voice input/output method comprising:

acquiring external noise arriving from an outside of a user by a noise acquirer arranged toward the outside of a body of the user;

accepting an input of a voice and outputting a voice to an ear canal of the user;

acquiring a mixed voice, in which the external noise, the output voice, and a main voice of the user transmitted from a vocal cord of the user through the ear canal are mixed;

performing noise cancellation by processing the mixed voice signal using a noise signal based on the external noise; and performing echo cancellation by processing the mixed voice signal using the voice signal.

(Supplementary Note 13)

There is provided a voice input/output program for causing a computer to execute a method, comprising:

acquiring external noise arriving from an outside of a user by a noise acquirer arranged toward the outside of a body of the user;

accepting an input of a voice and outputting a voice to an ear canal of the user;

acquiring a mixed voice, in which the external noise, the output voice, and a main voice of the user transmitted from a vocal cord of the user through the ear canal are mixed;

performing noise cancellation by processing the mixed voice signal using a noise signal based on the external noise; and performing echo cancellation by processing the mixed voice signal using the voice signal.

What is claimed is:

1. A voice input/output apparatus comprising:

a microphone that acquires external noise arriving from the outside of the user;

a speaker that accepts an input of a voice signal and outputs a voice to an ear canal of the user;

a main microphone that acquires a mixed voice, in which the external noise, the output voice, and a main voice of the user transmitted from a vocal cord of the user through the ear canal are mixed, and outputs a mixed voice signal;

a noise-canceling processor that processes the mixed voice signal using a noise signal based on the external noise; and an echo-canceling processor that processes the mixed voice signal using the voice signal, wherein the noise-canceling processor performs noise cancellation processing using a first adaptive filter, the echo-canceling processor performs echo cancellation processing using a second adaptive filter, and filter coefficients of the first and second adaptive filters are alternatively updated until each filter coefficient does not change.

2. The voice input/output apparatus according to claim 1, wherein the echo-canceling processor performs the echo cancellation processing on the mixed voice signal on which the noise cancellation processing has been performed in the noise-canceling processor.

3. The voice input/output apparatus according to claim 1, wherein the noise-canceling processor updates the first adaptive filter at a timing at which the main microphone does not acquire the main voice and the speaker is not outputting the voice.

4. The voice input/output apparatus according to claim 3, wherein the noise-canceling processor and the echo-canceling processor do not update the first adaptive filter and the second adaptive filter at a timing at which the main microphone acquires the main voice and the speaker is outputting the voice.

5. The voice input/output apparatus according to claim 1, wherein the echo-canceling processor updates the second adaptive filter at a timing at which the speaker is outputting the voice.

6. The voice input/output apparatus according to claim 5, wherein the noise-canceling processor and the echo-canceling processor do not update the first adaptive filter and the second adaptive filter at a timing at which the main microphone acquires the main voice and the speaker is outputting the voice.

7. The voice input/output apparatus according to claim 1, wherein the noise-canceling processor performs, using the external noise acquired by the microphone, the noise cancellation processing on the mixed voice signal on which the echo cancellation processing has been performed in the echo-canceling processor.

8. The voice input/output apparatus according to claim 1, further comprising sound insulation that limits an intrusion route of the external noise to the main microphone.

9. The voice input/output apparatus according to claim 1, further comprising an attachment and detachment detector that detects attachment and detachment of the voice input/output apparatus, wherein when the attachment and detachment detector has detected attachment of the voice input/output apparatus, at least one of the first adaptive filter and the second adaptive filter is updated.

10. The voice input/output apparatus according to claim 1, further comprising a transmitter that transmits the mixed voice signal processed by both the noise-canceling processor and the echo-canceling processor.

11. The voice input/output apparatus according to claim 1, further comprising a processor that controls an update amount of the filter coefficient of the first adaptive filter and an update amount of the filter coefficient of the second adaptive filter in dependence on a signal to noise ratio.

12. The voice input/output apparatus according to claim 1, further comprising a sound leakage-canceling processor that performs cancellation processing for cancelling a sound leakage mixed in the external noise using the voice signal.

13. A hearing aid comprising:

a microphone that is arranged toward an outside of a body of a user;

a speaker that accepts an input of a voice signal and outputs a voice to an ear canal of the user;

a main microphone that acquires a mixed voice, in which the external noise, the output voice, and a main voice of the user transmitted from a vocal cord of the user through the ear canal are mixed, and outputs a mixed voice signal;

a noise-canceling processor that processes the mixed voice signal using a noise signal based on the external noise; and an echo-canceling processor that processes the mixed voice signal using the voice signal, wherein the noise-canceling processor performs noise cancellation processing using a first adaptive filter, the echo-canceling processor performs echo cancellation processing using a second adaptive filter, and filter coefficients of the first and second adaptive filters are alternatively updated until each filter coefficient does not change.

14. The hearing aid according to claim 13, further comprising an amplifier that amplifies the voice signal to be input to the speaker.

15. A voice input/output method comprising:

acquiring external noise arriving from an outside of a user;

accepting an input of a voice signal and outputting a voice to an ear canal of the user;

acquiring a mixed voice, in which the external noise, the output voice, and a main voice of the user transmitted from a vocal cord of the user through the ear canal are mixed, and outputting a mixed voice signal;

performing noise cancellation by processing the mixed voice signal using a noise signal based on the external noise; and performing echo cancellation by processing the mixed voice signal using the voice signal, wherein the noise cancellation processing is performed using a first adaptive filter, the the echo cancellation processing is performed using a second adaptive filter, and filter coefficients of the first and second adaptive filters are alternatively updated until each filter coefficient does not change.

* * * * *